US008869496B2

(12) United States Patent
Laumer et al.

(10) Patent No.: US 8,869,496 B2
(45) Date of Patent: Oct. 28, 2014

(54) DEVICE FOR FILLING CONTAINERS

(75) Inventors: Roland Laumer, Regensburg (DE); Johann Justl, Regensburg (DE)

(73) Assignee: Krones AG, Neutraubling (DE)

( * ) Notice: Subject to any disclaimer, the term of this patent is extended or adjusted under 35 U.S.C. 154(b) by 332 days.

(21) Appl. No.: 12/937,216

(22) PCT Filed: Apr. 3, 2009

(86) PCT No.: PCT/EP2009/054005

§ 371 (c)(1),
(2), (4) Date: Oct. 8, 2010

(87) PCT Pub. No.: WO2009/124885

PCT Pub. Date: Oct. 15, 2009

(65) Prior Publication Data

US 2011/0023996 A1 Feb. 3, 2011

(30) Foreign Application Priority Data

Apr. 12, 2008 (DE) ..... 10 2008 018 516

(51) Int. Cl.
*B65B 43/42* (2006.01)
*B67C 7/00* (2006.01)

(52) U.S. Cl.
CPC ..... *B67C 7/0073* (2013.01)
USPC ..... 53/281; 53/173; 53/287; 53/425

(58) Field of Classification Search
CPC . B67C 7/0073; B67C 2007/006; A61J 3/074; A61J 3/078; B65B 3/003; B65B 7/2807; B65B 61/28; B65B 7/20; B65B 7/2878; B65B 9/2049; B65B 9/2042
USPC ..... 53/173, 281, 287, 425, 467, 473, 474, 53/478, 484, 485
See application file for complete search history.

(56) References Cited

U.S. PATENT DOCUMENTS

| | | | | |
|---|---|---|---|---|
| 4,707,334 | A * | 11/1987 | Gerhard | 422/28 |
| 4,987,726 | A * | 1/1991 | Petho et al. | 53/510 |
| 4,992,247 | A * | 2/1991 | Foti | 422/304 |
| 6,354,427 | B1 | 3/2002 | Pickel et al. | |
| 6,520,318 | B1 | 2/2003 | Humele | |
| 7,739,859 | B2 * | 6/2010 | Colato et al. | 53/426 |
| 7,832,185 | B2 * | 11/2010 | Mastio et al. | 53/426 |
| 7,900,422 | B2 * | 3/2011 | Fischer | 53/426 |
| 8,117,803 | B2 * | 2/2012 | Nishino et al. | 53/167 |
| 8,132,598 | B2 * | 3/2012 | Mastio et al. | 141/51 |
| 2001/0010145 | A1 * | 8/2001 | Tawa et al. | 53/425 |

(Continued)

FOREIGN PATENT DOCUMENTS

| | | | |
|---|---|---|---|
| DE | 31 33 341 | A1 | 3/1983 |
| DE | 198 16 239 | A1 | 10/1999 |

(Continued)

*Primary Examiner* — Hemant M Desai
(74) *Attorney, Agent, or Firm* — Novak Druce Connolly Bove + Quigg *LLP*

(57) ABSTRACT

A device for filling containers with liquid may include a first transport, which transports a plurality of containers through a filling chamber. The filling chamber may include a sterile space. A plurality of treatment members may be arranged in the filling chamber for treating the containers, with at least one of these treatment members being a filling member which fills the containers with the liquid. The first transport may be designed in such a way that it transports the containers through the filling chamber in a cyclic manner.

21 Claims, 4 Drawing Sheets

(56) References Cited

U.S. PATENT DOCUMENTS

| | | | | |
|---|---|---|---|---|
| 2002/0083682 | A1* | 7/2002 | Edwards et al. | 53/426 |
| 2004/0253156 | A1* | 12/2004 | Stahlecker et al. | 422/302 |
| 2005/0188651 | A1* | 9/2005 | Clusserath | 53/136.1 |
| 2009/0017747 | A1* | 1/2009 | Wu et al. | 454/189 |
| 2009/0045350 | A1* | 2/2009 | Humele et al. | 250/455.11 |

FOREIGN PATENT DOCUMENTS

| | | | |
|---|---|---|---|
| DE | 198 35 369 | C1 | 10/1999 |
| DE | 199 22 873 | A1 | 11/2000 |
| DE | 10 2004 017 737 | A1 | 11/2005 |
| EP | 1 834 878 | A1 | 9/2007 |
| GB | 707572 | | 4/1954 |

* cited by examiner

Fig. 5
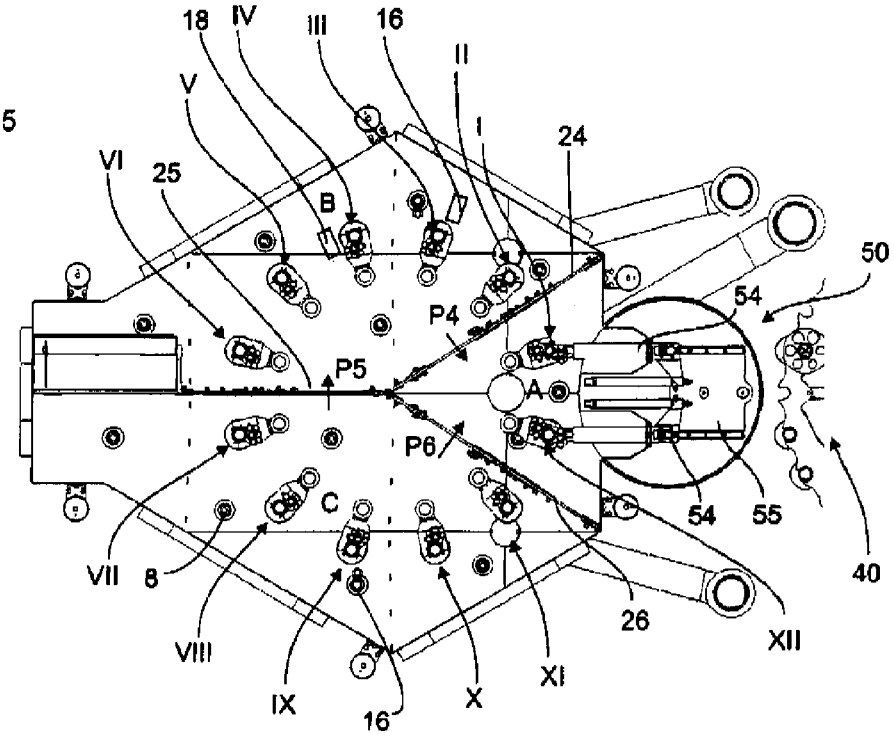
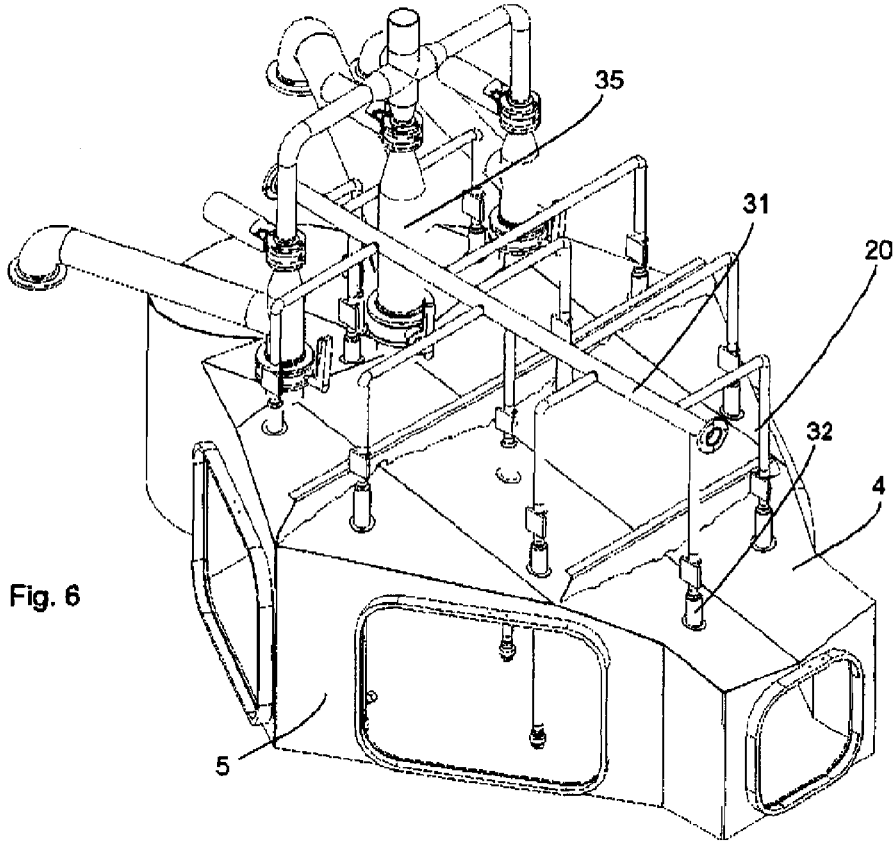
Fig. 6

Fig. 7
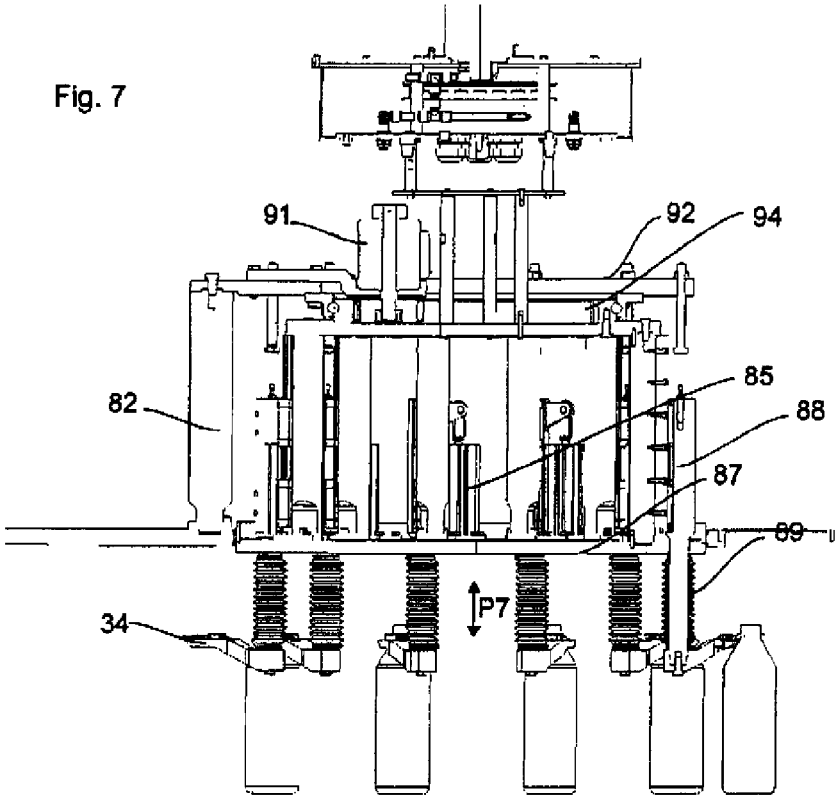
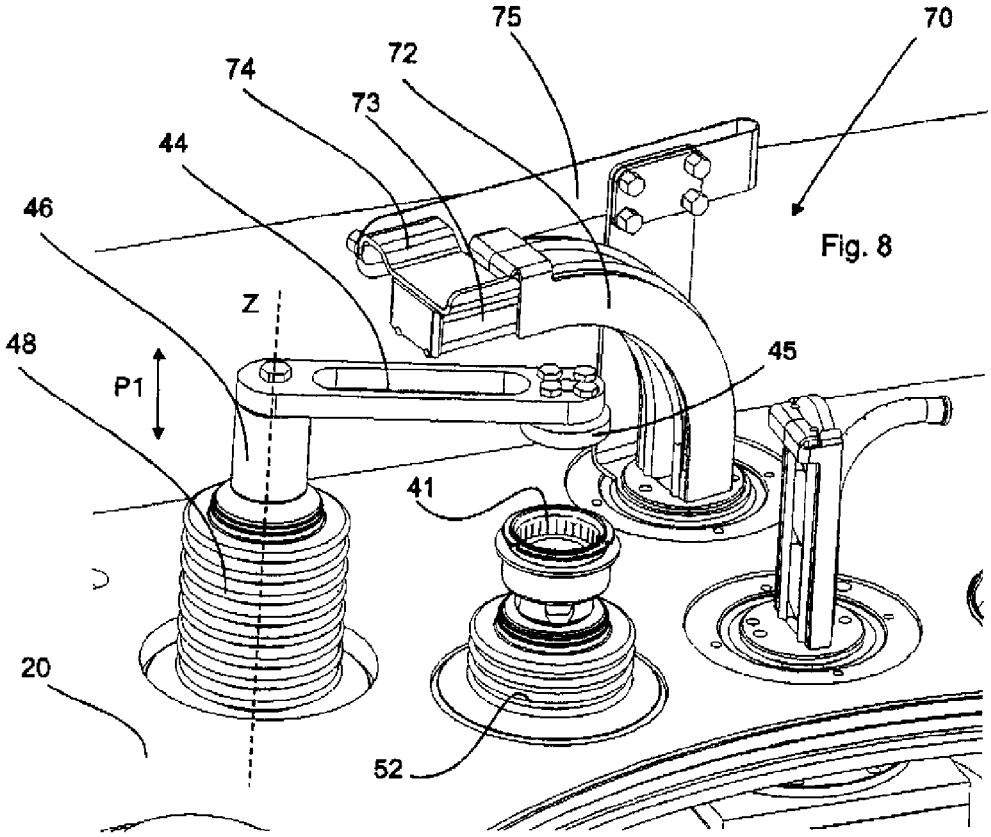
Fig. 8

DEVICE FOR FILLING CONTAINERS

CROSS-REFERENCE TO RELATED APPLICATION

This application is filed under 35 U.S.C. 371 as a U.S. national phase application of PCT/EP2009/054005, having an international filing date of Apr. 3, 2009, which claims the benefit of German Patent Application No. 10 2008 018 516.7, haying a filing date of Apr. 12, 2008, both of which are hereby incorporated by reference.

TECHNICAL FIELD

The present invention relates to a device for filling containers. Such devices are known from the prior art. As a rule, a plurality of filling members is provided, which move together with transport means and which fill the containers during the continuous movement of the latter. Also, aseptic filling systems are known from the prior art, wherein the containers are filled within a sterile space.

BACKGROUND

From DE 198 35 369 C1, a container processing machine is known. In this processing machine, support means which carry a unit and a plurality of processing stations are arranged above the processing stations of the unit.

DE 199 22 873 A1 discloses a device for feeding containers into a treatment chamber and/or out of it. Here, outer and inner pairs of star wheels as well as gripping and holding devices for the containers are provided.

DE 198 16 239 A1 describes a device for feeding containers into or out of a treatment chamber. Here, lock chambers which are open towards the outside are provided, with a lock wheel including grippers being provided, which can be directly actuated by the containers and/or indirectly by means of a control device, which lock wheel temporarily locks the containers in the lock chambers.

A beverage filling device is known from DE 198 17 735 C1. This has a stationary filling member in a treatment chamber which surrounds the container engagement portion of the filling member and the container positioned in the filling position and onto which an inert gas is applied, and the containers can be fed through an opening in this chamber. Further, an inlet chamber is provided, via which the opening towards the outside and towards the treatment chamber can be locked by means of lock gates.

In the so-called cold-aseptic filling process, the containers to be filled and the caps are first sterilised and after that, the previously sterilised product is filled in within an enclosed, sterile environment, the so-called clean room. The containers are closed under aseptic conditions.

As mentioned, it is standard practice here in the prior art for the corresponding filling members to move together with the containers to be filled. As a result, however, further process engineering problems arise, since for example the movable filling members have to be supplied with the medium to be filled in, which entails further sealing efforts. The present invention is therefore based on the desire to provide a device for filling containers with liquids, which is cost-effective in production and which enables a simple operation.

SUMMARY

A device according to the invention for filling containers comprises transport means which transport a plurality of containers through a filling chamber, said filling chamber preferably being a sterile space. Further, a plurality of treatment members arranged in the filling chamber is provided, which treatment members treat the containers, with at least one of these treatment members being a filling member that fills the containers with the liquid.

According to the invention, the transport means are designed in such a way that they transport the containers through the filling chamber in a cyclic manner. A filling chamber is to be understood to mean the room through which the containers are guided and within which they are filled with a liquid. The liquid may for example be a beverage, but it would also be possible to fill in drugs or other pharmaceutical products. A sterile room is to be understood to mean that the filling chamber is isolated in particular against the external environment.

The object is, on the one hand, to prevent any air from entering into the filling chamber from the outside, conversely, however, also any escape of gases out of the filling chamber to the outside is to be prevented. Preferably, a housing is provided around the filling chamber, which seals the latter. Unlike the prior art, it is thus proposed according to the invention not to transport the containers in a continuous movement, but in a cyclic movement.

Preferably, the treatment members are at least partly arranged to be stationary. Here, also other treatment members are preferably provided apart from the filling members, for example members which close the containers with a cap, members which carry out a sterilisation operation on the containers and the like. By means of the stationary arrangement of the filling members and preferably also of further treatment members, the overall device is simplified, since for example no additional rotary seals need to be provided and in this way the sealing effort may be reduced. In this way, any rotary distributors may be dispensed with as well.

In a further preferred embodiment, the device includes a further transport unit which both hands over containers at least and preferably indirectly to the transport unit and also takes over containers at least and preferably indirectly from the transport means. This may here be a transfer wheel which introduces the containers into the sterile space or into the filling chamber preferably via a lock device. Thus, only one transport unit is provided herein, which both hands over empty containers to the device or the transport means and takes over filled and closed containers from said transport means. In this way it is possible to provide just one access to the transport means, via which containers are both fed in and out.

Preferably, a lock device is provided in the transport direction of the containers between the first transport means and the further transport unit, which lock device both takes over empty containers from the further transport unit and hands them over to the first transport means and also takes over filled and closed containers from the first transport means and hands them over to the further transport unit.

In a further advantageous embodiment, the first transport means includes a transport wheel which transports the containers at least in sections along a path extending in a circuit. Such transport means will be referred to below as rotary systems. The containers are thus transported by this device along a circular path in a cyclic manner.

Preferably, the transport unit includes a lock device which prevents any air from entering into the filling chamber. Here, the containers are introduced into the lock chamber and are subsequently passed on to the transport means. As mentioned above, a combined inlet/outlet star is used in order to transport the containers to the transport means or away from the transport means. Preferably, also the lock device is located within the filling chamber and thus within a clean room.

In a further advantageous embodiment the lock device is a rotary lock device. This means that the containers are preferably introduced into the lock device and are subsequently rotated about a rotary axis of the lock device. Preferably here also the rotation of the containers within the lock device is carried out in a cyclic manner. In this way handing over or taking over of the containers to or from the transport means is facilitated.

In a further advantageous embodiment, the lock device has at least one gripping element for gripping the containers, said gripping element being arranged both to be slidable in a linear direction and to be pivotable. Thus, the containers are first gripped, are subsequently drawn into the lock device and are finally pivoted, so that they can be passed back to the transport means. This will be explained in more detail with reference to the figures.

In a further advantageous embodiment, the further transport unit comprises an even number of gripping elements for gripping the containers. Preferably, two or four such gripping elements are provided. Here, a gripping element or each first gripping element is used to hand over an empty and unclosed container to the transport means and the respectively second or a second gripping element is used for taking over the filled and closed containers from the transport means.

Preferably, the gripping elements are active gripping elements. This means that the gripping elements are able to close by themselves, in order to grip a container in particular by its bottle neck.

For example, it is possible for the lock device to take over an empty container from an inlet star by a linear carriage of the lock device moving outwards. After a pneumatically driven handover (or when the gripping element closes), the above-mentioned linear carriage will move back into the lock with the empty bottle. Upon pivoting the lock by 180°, the linear carriage will move back out again and the empty container will be handed over to the corresponding gripping device of the transport means, which by then will have moved into position.

In a further advantageous embodiment, the device has a central carrier on which essentially all of the treatment members of the device or the operating elements thereof are arranged. Operating elements are to be understood to mean here, for example, the elements of a capper, the filling members, elements for rinsing the containers, elements for internal disinfection of the containers and the like. By arranging these elements on a central carrier, the overall accessibility of the device and servicing are facilitated. The central carrier is preferably a cover that closes the filling chamber. Thus, in this embodiment, the operating elements of the device are arranged to be suspended from this cover. In this way, also an internal sterilisation of the device is facilitated.

In a further advantageous embodiment, the device comprises a plurality of liquid distribution devices arranged inside of the filling chamber. More specifically, a CIP (Clean In Process) system is installed for cleaning and disinfecting the filling chamber. Here, a plurality of individually controllable nozzles is distributed inside the filling chamber. These enable the entire filling chamber to be cleaned. Here, preferably, the piping of this cleaning system is laid out in such a way that all pipes will automatically run empty when the system is bled. Preferably, rotary spray heads are used for an effective cleaning of the internal space, i.e. spray heads which, preferably under rotation, dispense the cleaning liquid in the circumferential direction. Also the piping for this internal cleaning is preferably arranged on the above-mentioned cover or carrier.

In a further advantageous embodiment, a closing device is disposed inside the filling chamber, in order to close the containers with caps. In order to close the container, a sterilised cap has to be transported to the closing cone of the capping unit.

Preferably, the closing device has a drive that is arranged outside the filling chamber. Devices are known from the prior art wherein the entire capping unit including the motor and the drive is arranged in the clean room. However, this means that relatively large surfaces have to be cleaned. Therefore, it is proposed in the present embodiment for the mechanics and the drive to be arranged to be freely accessible from outside of the filling chamber and only the exchangeable closure cone, which subsequently turns the caps onto the containers, is mounted inside the filling chamber. Thus, the closure head is here isolated. A further advantage consists in that the mechanics can be serviced during running operation and a renewed cleaning operation of the filling chamber is not necessary.

The closing device preferably includes a pivot arm which pivots the cap. As explained above, the object consists in transporting the screw caps from a closure rail into the cone of the closing unit. In this process, the cap is not to be contacted or held by its internal thread, since this would again introduce the risk of contamination. Upon sterilisation, the caps slide into a rail. Subsequently, the pivot arm carries out a pivoting movement towards the end of this rail, where a cap is already present. The pivot arm takes this cap and pivots back above the cone of the closing member.

The pivot arm may preferably be lowered and lifted in its entirety. This means that apart from its pivoting movement, the pivoting arm also carries out a vertical upward and downward movement. Due to the lifting of the pivot arm the cap is clamped in the above-mentioned cone, subsequently the pivot arm is lowered again and a new cycle begins.

Preferably, the pivot arm is arranged on a shaft and this shaft is surrounded in its circumferential direction by a bellow. As explained above, the pivot arm carries out a pivoting movement as well as a lifting and lowering movement. In order to achieve in this way a seal against the filling chamber, the above-mentioned bellow is provided which at the same time takes over this isolating function.

The present invention is further directed to a method for filling containers with liquids, wherein the containers are transported by transport means through a sterile filling chamber and are treated within this preferably sterile filling chamber using a plurality of treatment members arranged in the filling chamber, with at least one of these treatment members being a filling member which fills the containers with the liquid. According to the invention, the containers are transported through the filling chamber in a cyclic manner.

Thus, also in the method according to the invention it is proposed to transport the containers not in a continuous movement but in a cyclic manner. In this way here too, the respective treatment members may be arranged within the filling chamber to be stationary. The filling chamber is preferably a sterile space.

In a preferred method, an empty container is supplied to the transport means and respectively at the same time a full container is carried away by the transport means. By means of this simultaneous feeding in and out, both the feeding in of the containers and the feeding out of the containers may be achieved by means of just one transfer device. In this way, the number of accesses and openings in the filling chamber may be reduced.

Preferably, both filled and unfilled containers are transported by a transport unit for the containers at the same time, which transport unit is also referred to as an inward and outward transport unit. Preferably, this is an inlet or outlet star on which both filled, and thus closed, containers and unfilled containers, which means containers to be filled, are arranged at the same time.

Preferably, the containers are handed over from the transport unit to the first transport means via a lock device. By means of this lock device air is prevented from entering into the filling chamber and, conversely, any aggressive gases present, such as for example hydrogen peroxide, are prevented from escaping from the inside of the filling chamber. The lock device is here suited both for receiving the filled containers and for receiving the unfilled containers.

BRIEF DESCRIPTION OF THE DRAWINGS

Further advantageous embodiments will become evident from the attached drawings, wherein:

FIG. 5 shows a top view of part of the device from FIG. 1 for illustrating different workstations;

FIG. 6 shows a view for illustrating piping for the device;

FIG. 7 shows a view for illustrating the transport of the containers; and

FIG. 8 shows a view of a closing unit for a device according to the invention.

DETAILED DESCRIPTION

Figure 1:
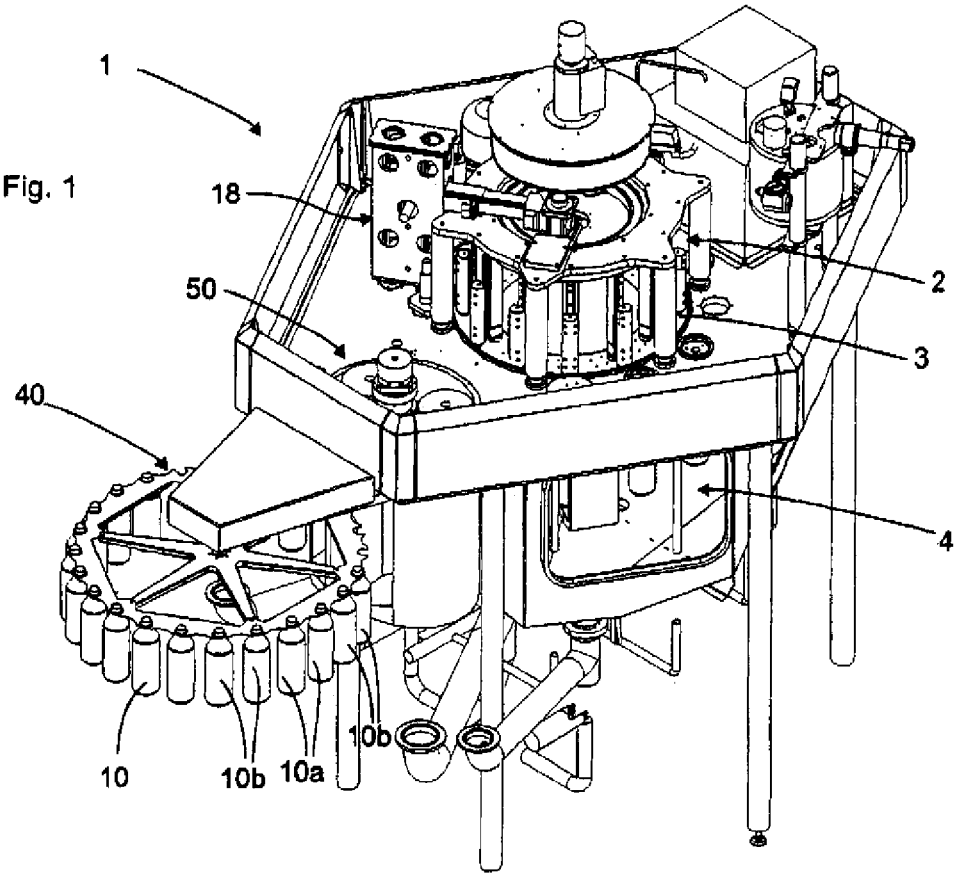
FIG. 1 shows an overall view of a device according to the invention.

FIG. 1 shows a simplified view of a device 1 according to the invention. This device 1 comprises a filling chamber 4, within which the containers 10 are guided and are, amongst other things, also filled with a liquid such as for example a beverage. Here first of all, empty and open containers are supplied to the filling chamber and filled and closed containers are carried off via a further transport unit which is implemented as a combined inlet/outlet star. In FIG. 1, each empty container is identified with the reference numeral 10*a* and each filled container is identified with the reference numeral 10*b*. It can be seen that in each case two unfilled containers 10*a* and subsequently two filled containers 10*b* are arranged next to each other. In the embodiment shown at 1, the further transport unit 40 rotates in a clockwise direction. Reference numeral 50 refers to a lock device which both takes over empty containers 10*a* from the further transport unit 40 and hands over filled containers 10*b* to said further transport unit 40. At the start of operation, said transport unit 40 is here filled by hand with empty containers 10*a*.

Reference numeral 3 refers to a transport wheel on which the individual containers are transported along a circular path.

Figure 2:
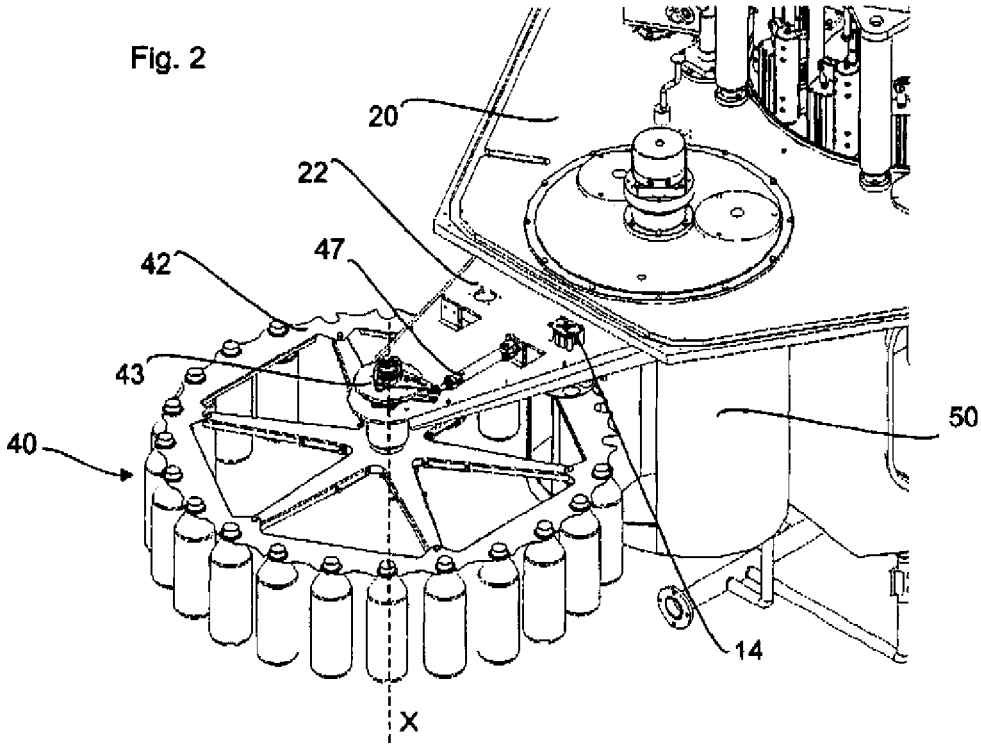
FIG. 2 shows a detail of the device from FIG. 1.

FIG. 2 shows a detailed view of the device shown in FIG. 1. It can be seen that the further transport unit 40 may be rotated about a rotary axis X. Reference numeral 47 relates here to a drive mechanism which drives a toothed wheel 43 and thus also the carrier 42 in a cyclic manner. In this process, a cyclic rotary movement is alternately carried out about a circumferential angle between 15° and 45°. Each cycle of this rotary movement is followed by a rest period, during which the containers are handed over to the lock device 50. During this operation, the carrier 42 is preferably rotated by one position of the containers after each handover/takeover of containers.

However, it would also be possible to rotate the carrier after each handover/takeover by two positions and to arrange in each case alternately an empty and a full container on the carrier. Also, the lock means could include four or more gripping elements which are arranged next to each other. Apart from that it would also be possible for the lock means to include a total of 4 gripping elements, wherein two elements are respectively moved in the direction of the further transport unit and two further elements in the direction of the transport means 2.

Figure 3:
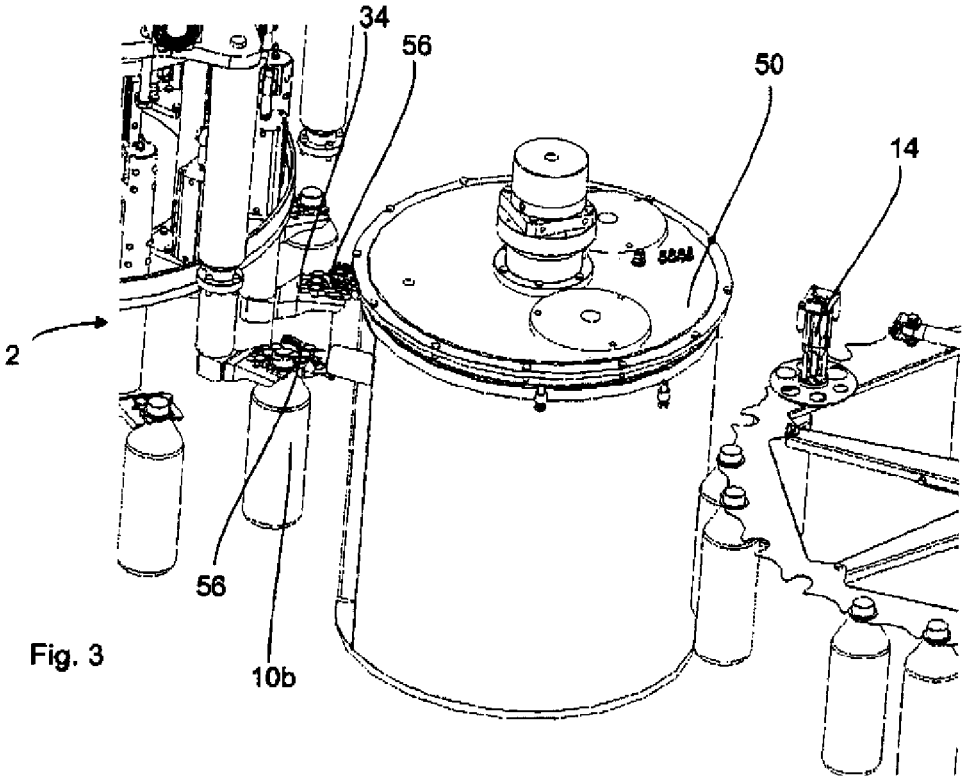
FIG. 3 shows a lock device for the device from FIG. 1.

FIG. 3 shows a view of the lock means 50, which is in the process of taking a filled and closed container 10*b* over from the transport means 2 and of handing an open and empty container over to the transport means essentially at the same time (not shown).

Figure 4:
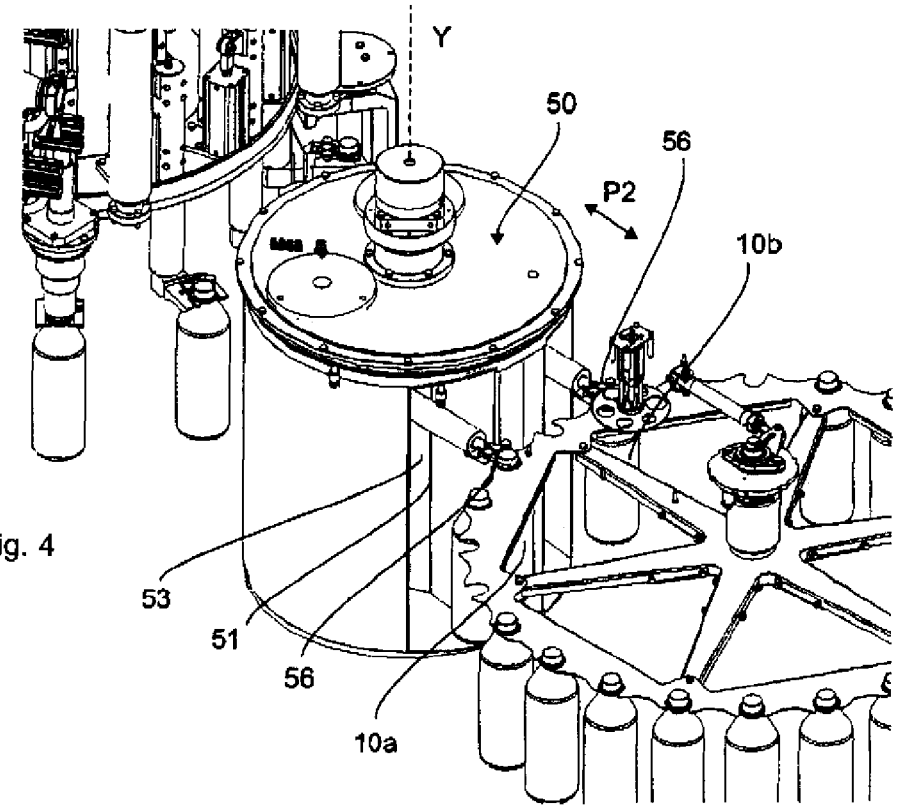
FIG. 4 shows the lock device from FIG. 3 whilst taking over containers from the further transport means.

FIG. 4 shows a situation in which an empty container 10*a* is in the process of being taken over by the further transport unit 40 and at the same time a filled container 10*b* is handed over by the lock device 5 to the transport unit 40. To this end, the lock device includes gripping elements 56 which may grip the containers preferably by their neck. These gripping devices 56 may be displaced along the arrow P2, so that the containers may be drawn into an inner space 51 of the lock device. After this drawing in, the lock device is rotated about its rotary axis y by 180°, in order to enable a corresponding handover to the transport means 2 or a takeover from the transport means 2 to be carried out. Preferably, the lock device therefore has a support with a pivot drive.

The containers are transported within a lock cell 53.

Upon pivoting the lock device 50, a linear carriage (not shown in FIG. 4) will move back out and the empty container 10*a* is handed over to a clamp or the gripping element 34 of the transport means 2 (FIG. 3), which clamp or gripping element has already been moved into its position. The container is now located with the support ring on the above-mentioned clamp 34 of the transport means 2 and is handed to the transport means 2 over by opening the clamp or the gripping element 56. Once the lock device has pivoted back by 180°, the carriage moves back out and a new cycle begins. Reference numeral 14 identifies an inspection device which checks whether caps have been attached to the containers 10.

FIG. 5 shows a top view of the device according to the invention for illustrating the various areas. Here, the individual working steps are identified with Roman numerals I-XII. In step I, an empty and contaminated container is handed over by the lock device 50. In step II, the container 10 is externally sterilised and is preheated with hot air in a step III. Subsequently, a continuous internal sterilisation of the container with an $H_2O_2$/air mix is carried out in a step IV. This is followed by a discontinuous internal sterilisation of the container with an $H_2O_2$/air mix in a step V. In a step VI, the container is rinsed with sterile air.

Reference numeral VII identifies a free or unused station. In a step VIII, the container is, for example, filled with a beverage and subsequently liquid nitrogen is introduced into the container (step IX). Finally, the container is closed with a screw cap (step X) and is sealed in a step XI with an aluminium seal. Finally, the full container is handed over to the lock device 50 (step XII).

In order to be able to carry out the individual working steps I-XII and in particular the working steps II-XI, the device 1 includes several treatment members which are arranged on the carrier 20 to be stationary. The containers are each moved in relation to these treatment members. Reference numeral 8 shows (only schematically) a filling member for filling the containers. Reference numerals 16 and 18 show (again only very schematically) two further treatment members for carrying out steps III and IV. The individual treatment members are arranged along a circular path, which path also corresponds to the transport path of the containers.

The filling chamber 4 is subdivided into three zones A, B, C by three separator disks 24, 25, 26. In zone A, a vacuum in the order of 5-10 Pascal is preferably present. This vacuum is necessary in order to ensure that no $H_2O_2$ steam can escape from the system via the lock 50. This vacuum is maintained via an exhaust air control.

In zone B, the above-mentioned stations for sterilising the container are located. The part of the system that is charged with $H_2O_2$ steam is operated with a slight positive pressure of approximately 10 Pascal. In this way, a continuous overflow (arrow P4) into the handover zone A of the lock device 50 is achieved. Here, too, the pressure level is maintained by means of an exhaust air control.

In zone C, the pressure in this sterile zone is selected (e.g. 20 Pascal of positive pressure) such that overflows (arrows P4, P5, P6) occur in the two adjacent zones A, C. In this way, any contamination by unsterile air from zone A and any contamination by air charged with $H_2O_2$ from zone B may be prevented. Also, the transport means 2 shown in the figures is operated as mentioned above in a cyclic manner and here, preferably, an electric servomotor is provided which carries out a cyclic pivoting movement, for example in 30° increments.

Reference numeral 55 relates to a carrier provided in the lock device 50, opposite of which a carriage 54, on which in turn the gripping elements 56 are arranged, may be displaced in the direction P2. Here, the lock device 50 is arranged relative to the transport means 2 in such a way that in an extended condition, the two gripping elements 56 of the lock device are moved up to the gripping elements 34 of the transport means at the same time, so that both an empty container may be handed over and a full container may be taken over essentially at the same time. Correspondingly, also the lock means 50 is arranged relative to the further transport unit in such a way that the above-mentioned simultaneously take-over and handover becomes possible. However, it would also be possible to provide carriages for the two gripping elements 56, which may be driven independently from one another.

FIG. 6 shows a view of the filling chamber 4. This filling chamber 4 includes a base housing 5 with a carrier 20. On this carrier 20, the individual (not shown in detail) treatment elements of the device are arranged. Reference numeral 31 relates to CIP piping. Reference numeral 32 relates to cleaning nozzles used for cleaning the internal space of the filling chamber 4. To this end, a cleaning liquid is distributed, more precisely from the above-mentioned flow pipe 31, to 12 individually controllable nozzle blocks or cleaning nozzles 32 which enable the entire inside of the filling chamber to be cleaned. The piping is preferably laid out in such a way that all of the pipes 31 will automatically run empty when the system is bled. The spray heads are preferably rotary spray heads which allow detergent to exit over the entire circumference, i.e. about 180°.

Reference numeral 35 generally relates to all the piping for supplying the beverage as well as any further gases which are filled into the containers.

FIG. 7 shows an overall view of the transport means 2. This includes support elements 82. Reference numeral 34 relates to gripping elements which grip the containers. These gripping elements 34 may be lifted or lowered via a lifting drive 85 in the direction of arrow P7. Reference numeral 87 relates here to the ceiling of the filling chamber 4, i.e. a zone of a non-sterile room is provided above this ceiling. Reference numeral 86 relates to the lifting device for lifting and lowering the gripping elements 84. This lifting device 86 is here surrounded by a bellow 89 which provides for sterile sealing.

Reference numeral 91 identifies a servomotor having an upstream bevel gear as well as a gear wheel. By means of this servomotor, the transport means 2 is driven in a cyclic manner. A 4-point torque bearing 94 is fastened to a bearing plate 91. The bearing 94, which is equipped with internal toothing on the inner ring, may support high loads as an individual bearing and is almost free of play and is moreover cost-effective. On the inner ring, i.e. the internal toothing, the above-mentioned servomotor engages with the upstream bevel gear and the gear wheel.

FIG. 8 shows a closure device 70. In order to close the container with a screw cap, a sterile cap has to be initially transported into a closure cone 41. This is realised by handing it over to a pivot unit 44. FIG. 8 shows a bottom view of the closure unit. The screw caps (not shown) are initially moved from a cap rail 72 into a reception zone 73. By means of this rail 72 it is achieved that upon sterilisation, the caps point in the right direction with their openings facing downwards. The caps accumulate in front of the reception zone 73. Initially, a pivot arm 44 carries out a pivoting movement about the axis Z towards the rail end. In this zone, a cap is already present (not shown) on a deposit tray 74. This deposit tray 74 is arranged on a spring sheet 75. By pushing away the tray 74, a cap pushes onto the pivot arm 44 or the end 45 thereof, whilst it has to be noted here that the pivot arm pivots below the tray 74. This component 45 receives the cap on the pivot arm. After that, the pivot arm 44 pivots back below the cone 41. Apart from the pivoting movement, the pivot arm also carries out a vertical movement upwards and downwards along the arrow P1. By lifting the pivot arm, the cap is clamped into the cone 41.

It is to be noted here that a drive (not shown) of the pivot arm 44 is arranged outside of the filling chamber 4, i.e. in a non-sterile zone. A shaft 46 which is mounted on the pivot arm 44 thus extends through the cover of the pivot unit. Reference numeral 48 relates to a bellow which allows the pivot unit 44 to be pivoted in the direction of the arrow P1 as well as to be lifted and lowered. Thus, the bellow 48 on the one hand fulfils the function of sealing the rotary movement, but on the other hand it compensates for the lifting movement and finally also seals the closure unit on the plate or the carrier 20. The closure cone 41 is subsequently moved up to the container by a relative movement with respect to the container and screws the cap onto the mouth of the container. Here, the container may be moved up to the cone by a lifting movement, but it would also be possible to move the cone inversely in the direction of the container.

Thus, only the closure cone 41 of the closure unit protrudes into the clean room and its mechanics and drive are positioned on the carrier 20 to be freely accessible. Reference numeral 52 relates to a further bellow which is arranged on the closure cone 41 or the shaft thereof.

All of the features disclosed in the application documents are claimed as being essential to the invention in as far as they are novel over the prior art either individually or in combination.

What is claimed is:

1. A device for filling containers with liquids, comprising:

a first transport which transports a plurality of containers through a filling chamber, said filling chamber including a sterile chamber;

a plurality of treatment members arranged in the filling chamber for treating the containers, the plurality of treatment members including some treatment members configured to perform different treatments, at least one of said treatment members being a filling member which fills the containers with the liquid; and a rotary lock device arranged to hand containers between the first transport and a further transport unit, the lock device being configured to prevent air from entering into the filling chamber, wherein the first transport is structured and arranged to transport the containers through said some treatment members of the filling chamber in a cyclic manner.

2. The device as claimed in claim 1, wherein the treatment members are arranged to be at least partly stationary.

3. The device as claimed in claim 1, wherein the device comprises a further transport unit, which both hands over containers at least indirectly to the first transport and takes over containers at least indirectly from the first transport.

4. The device as claimed in claim 1, wherein the first transport includes a transport wheel which transports the containers at least in sections along a circular path.

5. The device as claimed in claim 1, wherein the lock device is arranged to hand containers from the further transport unit to the first transport and from the first transport unit to the further transport unit.

6. The device as claimed in claim 1, wherein the lock device includes at least one gripping element for gripping the containers, said gripping element being arranged both to be displaceable in a linear direction and to be pivotable.

7. The device as claimed in claim 1, wherein the lock device includes an even number of gripping elements for gripping the containers.

8. The device as claimed in claim 7, wherein the gripping elements of the lock device are active gripping elements.

9. The device as claimed in claim 1, further comprising a central carrier, on which essentially all of the treatment members of the device are arranged.

10. The device as claimed in claim 9, wherein the central carrier is a cover that closes the filling chamber.

11. The device as claimed in claim 1, wherein the device includes a plurality of liquid distribution devices arranged inside of the filling chamber.

12. The device as claimed in claim 1, further comprising a closure device arranged inside of the filling chamber in order to close the containers with caps.

13. The device as claimed in claim 12, further comprising a drive for the closure device arranged outside of the filling chamber.

14. The device as claimed in claim 13, wherein the pivot arm may be lowered and lifted in its entirety.

15. The device as claimed in claim 13, wherein the pivot arm is mounted on a shaft and said shaft is surrounded in its circumferential direction by a bellow.

16. The device as claimed in claim 12, wherein the closure device includes a pivot arm which pivots the cap.

17. A method for filling containers with liquids, the method comprising:

transporting containers through a sterile filling chamber via a transport;

treating the containers within said sterile filling chamber by means of a plurality of treatment members arranged in the filling chamber, the plurality of treatment members including some treatment member configured to perform different treatments;

filling the containers with a liquid by means of at least one of said treatment members which comprises a filling member for filling the containers with the liquid; and operating a rotary lock device arranged to hand containers between the first transport and a further transport unit, the lock device being configured to prevent air from entering into the filling chamber, wherein the containers are transported through said some treatment members of the filling chamber in a cyclic manner.

18. The method as claimed in claim 17, further comprising:

supplying an empty container to the transport means; and respectively, at the same time an empty container is supplied, carrying off a full container via the transport.

19. The method as claimed in claim 17, further comprising transporting both filled and unfilled containers at the same time on a transport unit for the containers.

20. The method as claimed in claim 17, further comprising handing over the containers from the transport unit to the transport via a lock device.

21. A device for filling containers with liquids, comprising:

a first transport which transports a plurality of containers through a filling chamber, said filling chamber including a sterile chamber;

a plurality of treatment members arranged in the filling chamber for treating the containers, at least one of said treatment members being a filling member which fills the containers with the liquid, the first transport being structured and arranged to transport the containers through the filling chamber in a cyclic manner; and a rotary lock device arranged to hand containers from a further transport unit to the first transport and from the first transport unit to the further transport unit, the rotary lock device being configured to prevent air from entering into the filling chamber.

* * * * *